US005253845A

United States Patent [19]

Wilbert

[11] Patent Number: 5,253,845

[45] Date of Patent: Oct. 19, 1993

[54] PORTABLE WELL PIPE AND PUMP PULLER

[76] Inventor: Robert A. Wilbert, 35 Paradise Trail, Stockholm, N.J. 07460

[21] Appl. No.: 911,103

[22] Filed: Jul. 9, 1992

[51] Int. Cl.[5] ..... E21B 19/00

[52] U.S. Cl. ..... 254/30

[58] Field of Search ..... 226/183, 186, 188, 170, 226/176, 181; 254/30, 29 R; 166/76, 77, 85, 384

[56] References Cited

U.S. PATENT DOCUMENTS

| | | | |
|---|---|---|---|
| 1,929,055 | 10/1933 | Carr . | |
| 2,433,477 | 12/1947 | O'Quinn et al. | 254/30 |
| 2,820,607 | 1/1958 | Dawes | 254/30 |
| 3,376,933 | 4/1968 | Burlett . | |
| 3,866,882 | 2/1975 | Willm et al. | 254/29 R |
| 3,871,618 | 3/1975 | Funk . | |
| 4,750,711 | 6/1988 | Landry | 254/30 |
| 4,986,351 | 1/1991 | Bowers . | |

FOREIGN PATENT DOCUMENTS

| | | | |
|---|---|---|---|
| 602668 | 3/1978 | U.S.S.R. | 254/30 |

*Primary Examiner*—Robert C. Watson

*Attorney, Agent, or Firm*—Jacobson, Price, Holman & Stern

[57] ABSTRACT

An apparatus for pulling a well pipe and downhole pump from a well and is constructed of relatively light-weight materials to enable the apparatus to be easily moved to a well site by the provision of a frame structure supported by relatively large wheels and a handle structure which enables the apparatus to be pushed, pulled or lifted for movement to an accurate orientation in relation to the well site and well casing with the apparatus providing a solid connection with the well casing for safe and efficient operation. The apparatus includes opposed belt structures for engaging opposite surfaces of a well pipe with the belt being driven by a motor and two worm gear speed reducers having outputs that turn drive axles in opposite directions which are drivingly connected to the belts and fork arms associated with the axles to enable adjustment of the contact area of the belts with the well pipe or other equipment which may be encountered when pulling a pump from a well.

14 Claims, 8 Drawing Sheets

PORTABLE WELL PIPE AND PUMP PULLER

BACKGROUND OF THE INVENTION

1. Field of the Invention

The present invention generally relates to an apparatus for pulling a well pipe and downhole pump from a well and is constructed of relatively lightweight materials to enable the apparatus to be easily moved to a well site by the provision of a frame structure supported by relatively large wheels and a handle structure which enables the apparatus to be pushed, pulled or lifted for movement to an accurate orientation in relation to the well site and well casing with the apparatus providing a solid connection with the well casing for safe and efficient operation. The apparatus includes opposed belt structures of engaging opposite surfaces of a well pipe with the belt being driven by a motor and two worm gear speed reducers having outputs that turn drive axles in opposite directions which are drivingly connected to the belts and fork arms associated with the axles to enable adjustment of the contact area of the belts with the well pipe or other equipment which may be encountered when pulling a pump from a well.

2. Description of the Prior Art

Various devices and procedures have been developed for pulling a well pipe or casing from a well by imparting an upward thrust or lift to the pipe or casing. The following U.S. patents disclose developments in this field in endeavor.

U.S. Pat. No. 1,929,055
U.S. Pat. No. 2,820,607
U.S. Pat. No. 3,376,933
U.S. Pat. No. 3,871,618
U.S. Pat. No. 4,986,351

The prior art does not disclose the drive belt assemblies of the above invention which are interconnected by flexible latch assemblies and the various supporting and driving arrangements to enable the belt assemblies to be adjusted and efficiently engaged with opposite surfaces of a well pipe, pump or other equipment being pulled from a well which are incorporated into this invention.

SUMMARY OF THE INVENTION

An object of the present invention is to provide a portable well pipe and pump puller utilizing opposed, elongated puller belts which are relatively wide with the outer surface tapering inwardly toward the center to force the pipe being pulled or extracted into a central groove.

Another object of the invention is to provide a puller in accordance with the preceding object in which the pulling belts are supported in a unique manner and can be adjusted to effectively engage different size well pipe and the like and the puller belt assemblies are interconnected by a flexible latch arrangement to maintain the puller belts in good frictional contact with the pipe being pulled.

A further object of the invention is to provide a puller in accordance with the preceding objects in which the puller is mounted on a mobile, wheeled frame in which the wheels are relatively large to enable the puller to be moved over rough terrain and the like to a well site with the mobile frame including a handle structure to enable it to be easily pulled, pushed or lifted into alignment with and engagement with a well casing or the like.

Still another object of the invention is to provide a pipe puller in accordance with the preceding objects in which the puller belts are driven from a motor having a pair of speed reducing outputs driving axles in opposite directions to drive the puller belts with fork arms being pivotally supported and supporting the puller belt assemblies to enable the center contact area of the belts to automatically adjust to the diameter of any pipe or equipment that may be encountered when pulling a well pipe and pump from a well.

A still further object of the invention is to provide a well pipe and pump puller in accordance with the preceding object which includes an overhead dual cone-shaped pipe guide to support a rigid pipe which may be made up into separable sections to enable the extracted pipe to arc under guided conditions to facilitate the pipe being effectively supported and easily pulled from a well in one continuous length without separation of individual sections.

Yet another important object of the present invention is to provide a portable, lightweight well pipe and pump puller or extractor that effectively pulls well pipes, pumps and other equipment from a well bore which is solidly connected to the well casing with structures being provided to effectively support the puller in lieu of the transport wheels which are relatively large and lightweight to avoid exerting excessive forces on the wheels.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
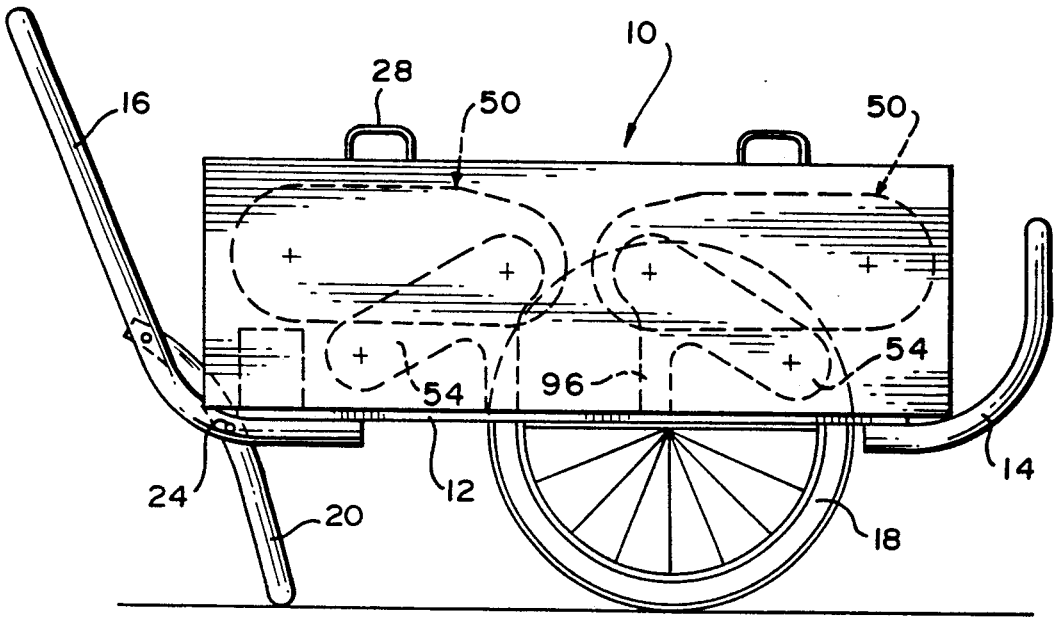
FIG. 1 is a side elevational view of the portable well pipe and pump puller of the present invention.

Referring now specifically to the drawings, the well pipe and pump puller of the present invention is generally as designated by reference numeral 10 and includes a base assembly 12 in the form of a generally rectangular plate having a front, generally U-shaped and upwardly curved handle 14 rigidly affixed to a end of the base assembly or plate 12. The base assembly or plate 12 also includes a rear handle 16 which is also generally U-shaped and longer than the front handle 14 and extends upwardly in a generally straight line condition in angular relation to the base assembly or plate 12. Mounted on the side edges of the base assembly 12 is a pair of wheels 18 rotatably supported from the plate or base assembly 12 at a point slightly closer to the front handle 14 than from the rear handle 16 as illustrated in the drawings. Each of the wheels 18 are relatively large diameter such as 16" spoked wheels having a pneumatic tire to enable the puller 10 to be pushed or pulled over uneven terrain to a well site. A support leg structure 20 is connected to the rear handle 16 and angles forwardly and downwardly in a curved manner to engage the ground surface in spaced relation to the wheels 18 with the leg structure also being generally U-shaped and connected to the rear handle 16 at two points. With this construction, the puller can be easily pushed or pulled to a well site and the handles 14 or 16 can be used to lift the puller if required. The large wheels enable movement over uneven terrain. The manner of attaching the wheels and handles to the base assembly or plate 12 is conventional and the wheels may be removed by removing cotter pins or the like to facilitate positioning of the puller on a well casing. This can be accomplished by merely lifting the apparatus by using the handles over the well and aligning the depending tubular machine support 22 that is rigid with the plate 12 into a well casing thus providing the apparatus with a solid connection to the well casing for safe operation. Removal of the wheels enables flush mounting when needed and the support legs stand can swing up out of the way by pulling a pin or spring handle assembly at 24. This pin can be a spring loaded pin with a T-handle on it for retraction to enable the leg stand 20 to swing out of the way thus enabling the plate 12 to be lowered to a point where it engages the upper end of the well casing into which the support 20 has been inserted.

As illustrated in FIG. 1, the puller includes a generally inverted U-shaped cover 26 having handles 28 thereon which completely covers and engages the plate 12 and can be secured thereto by latches of any conventional type to cover the machine during transport and storage and the cover 26 ca be easily lifted off to provide access to the apparatus.

Figure 2:
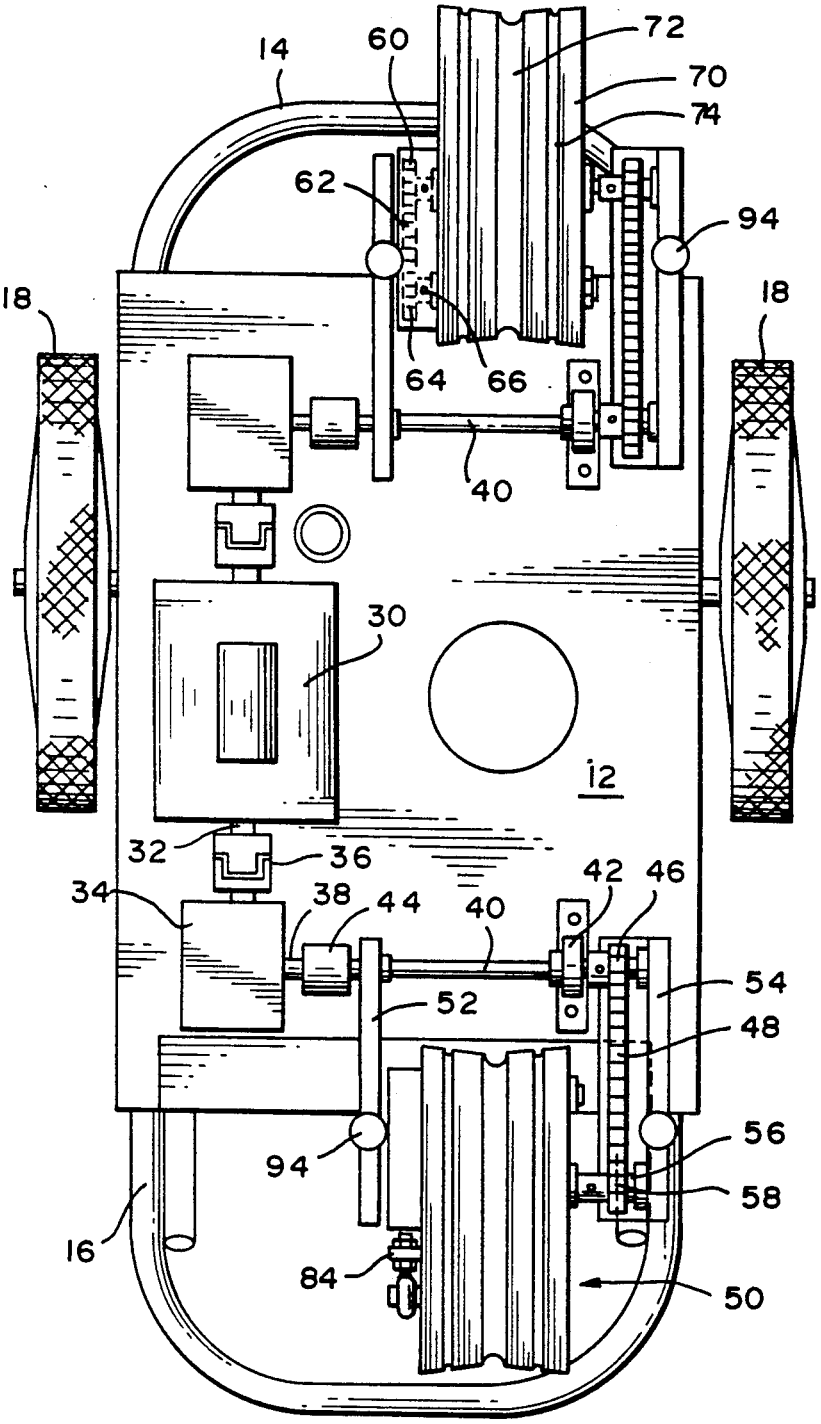
FIG. 2 is a top plan view of the puller with the belt drive assemblies in open position.
Figure 4:
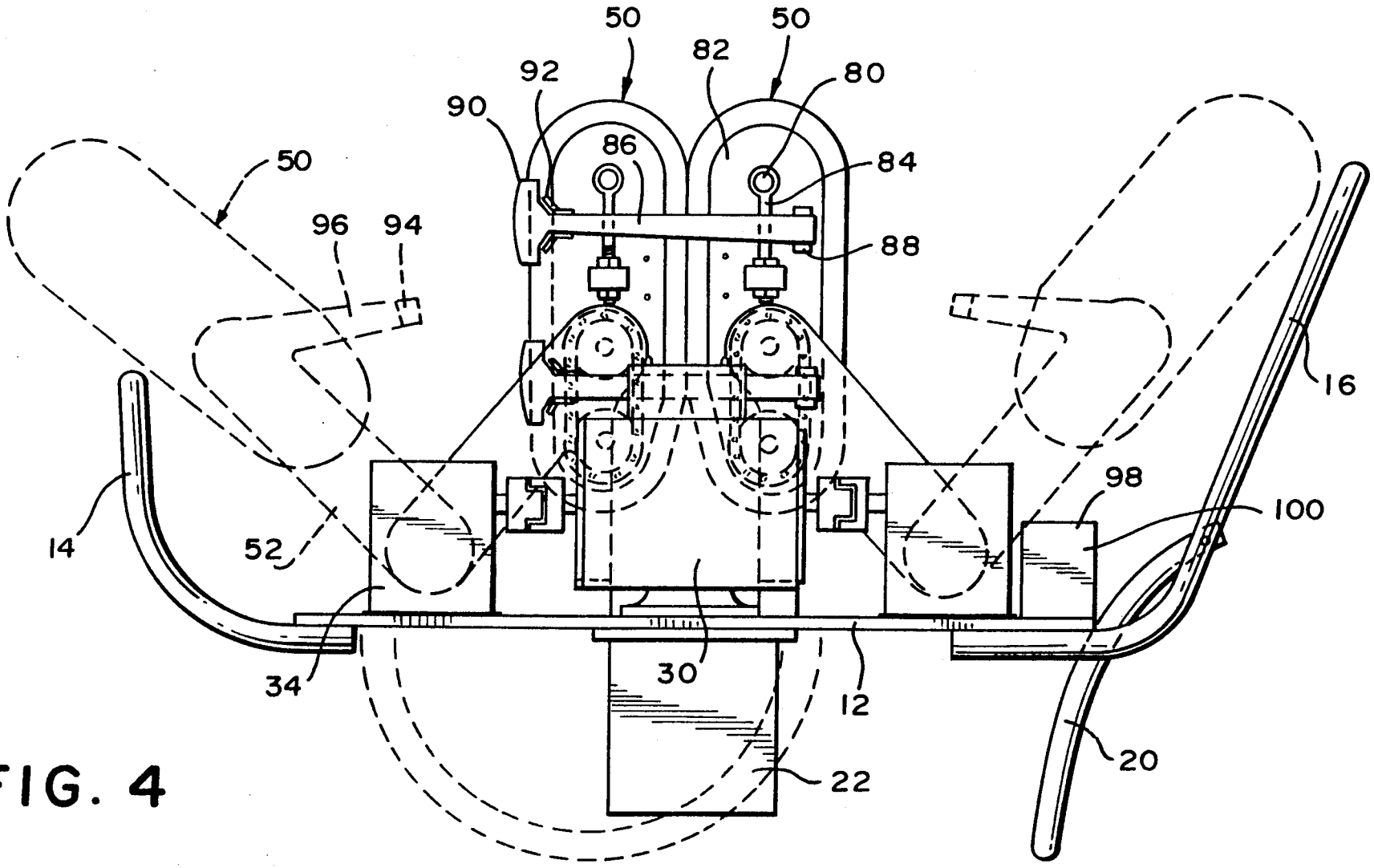
FIG. 4 is a side elevational view of the puller with the drive belt assemblies in closed position as illustrated in FIG. 3 with the drive belt assemblies being shown in broken line in their open position as illustrated in FIG. 2.
Figure 5:
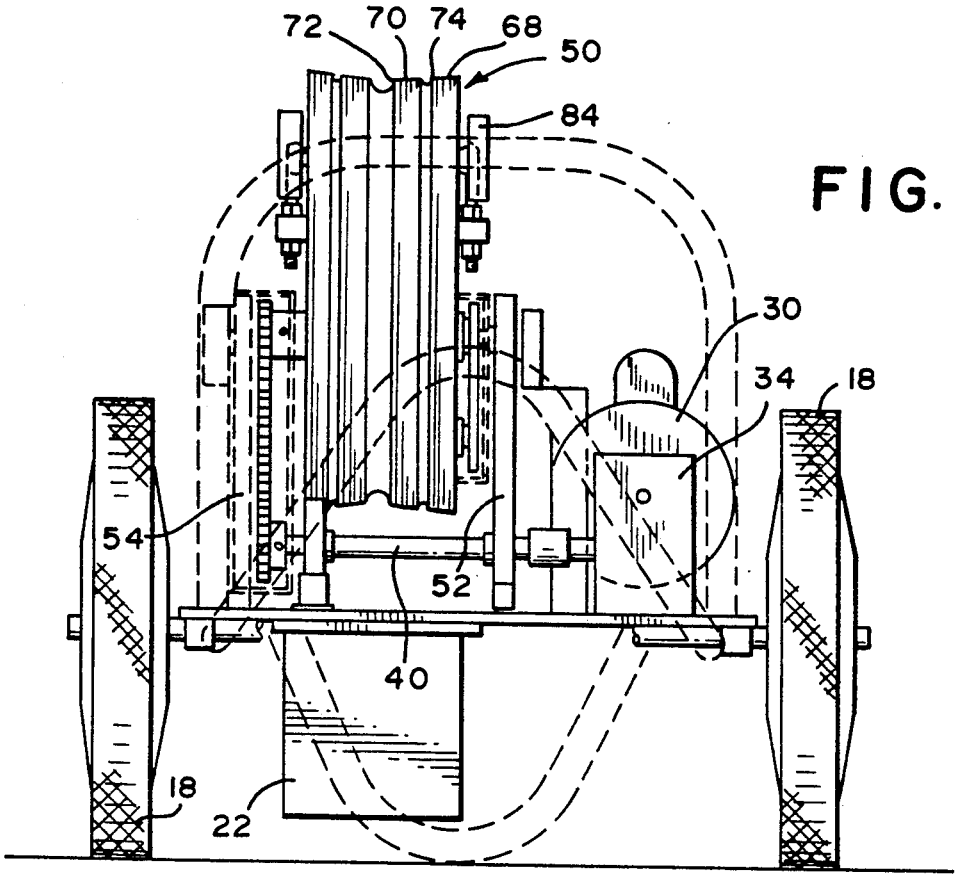
FIG. 5 is an end elevational view of the puller.

Supported from the plate 12 is a motor 30 in the form of an electric motor having an output shaft 32 extending from each end thereof for driving engagement with gear-type speed reducers 34 through a positive couplings 36. Since both of the shafts 32 function in the same manner, the function of only one shaft will be described in detail. The couplings 36 are preferably spider couplings and the speed reducer 34 includes an output shaft 38 to rotate a drive axle 40 supported on the plate 12 by suitable bearings 42 or the like with the speed reducers 34 driving the axles 40 in opposite rotational directions. The speed reducer output shafts are connected to the axle 40 by a positive coupling 44 with the bearings 42 being pillow block bearings or the like. The outer end of the axle 40 includes a sprocket gear 46 driving a sprocket chain 48 which drives a drive belt assembly generally designated by reference numeral 50. The axle 40 also supports a pair of fork arm 52 and 54 for pivotal movement about the axis of the axle 40. At the outer ends of the arms 52 and 54, a shaft 56 is journaled between the arms and extends through the belt drive assembly with a sprocket gear 58 mounted thereon for driving engagement with the sprocket chain 48. The other end of the shaft is provided with a sprocket gear 60 driving a sprocket chain 62 that engages a sprocket gear 64 which drives a shaft 66 at the inner end of the belt drive assembly 50 to be described in detail hereinafter. FIG. 2 illustrates the drive assemblies in their open or inoperative position which positions out of the way of the support 22 thereby enabling the machine to be associated with a well casing without the belt drive assemblies 50 being in the way. FIG. 4 illustrates the belt drive assemblies 50 in their closed or pipe engaging position.

Figure 3:
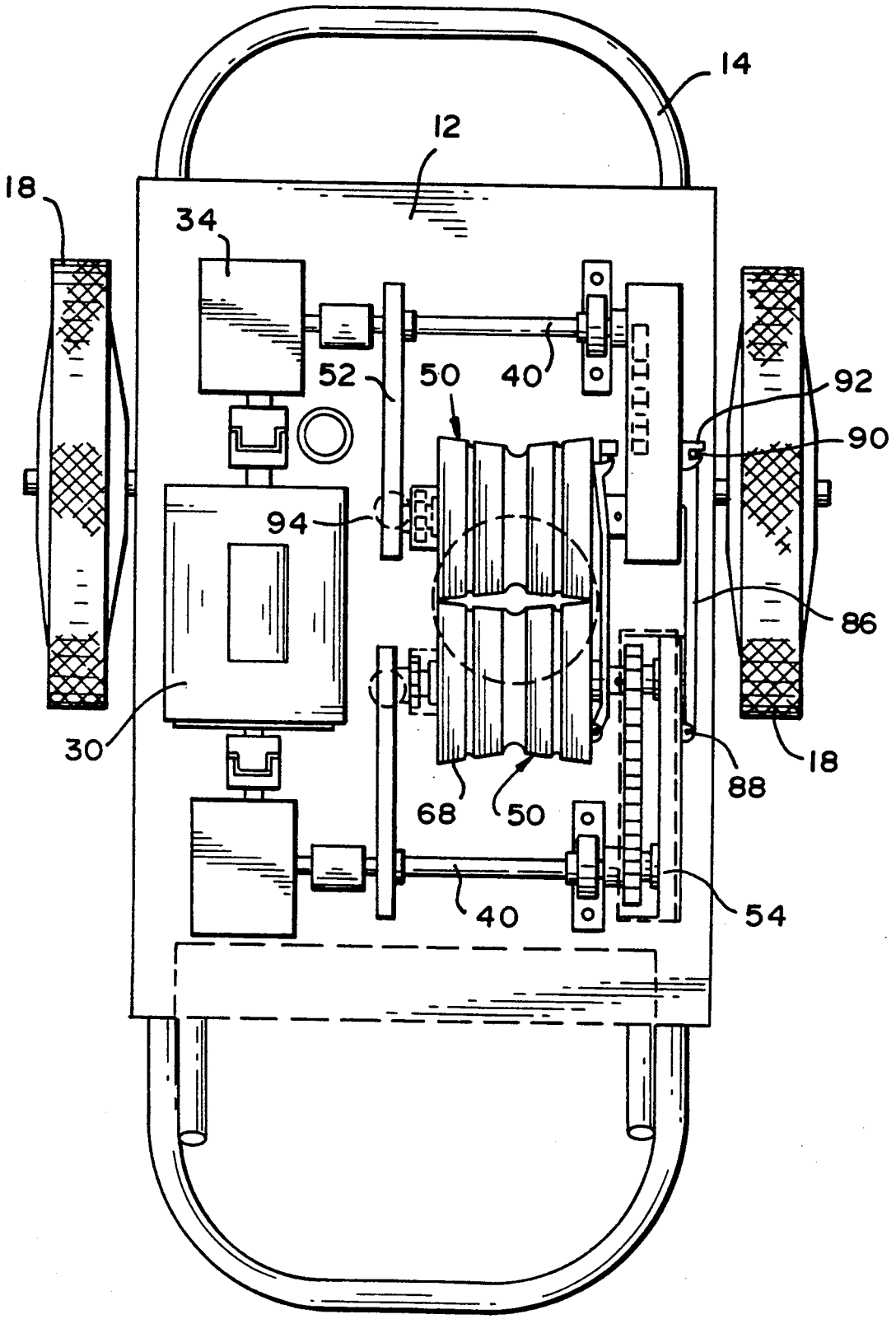
FIG. 3 is a top plan view similar to FIG. 2 but with the belt drive assemblies in their closed or working position to engage a pipe or pump.

Each belt drive assembly includes an elongated continuous, wide belt 68 which has an outer face which tapers inwardly towards the center as illustrated in FIGS. 2 and 3 and as designated by reference numeral 70 with the belt having a central groove 72 and a pair of smaller grooves 74 between the central groove and the outer edges of the belt. Each of the belts is entrained around a pair of multi-groove pulleys 76 which are associated with the interior groove surface 78 of the belt 70. The pulleys 76 are supported from shafts 80 extending through plates 82 with the upper shaft being received in a slot and provided with a tension adjustment mechanism 84 to maintain tension and thus frictional driving engagement between the pulleys and belts with the lower most pulley 80 being connected with the shaft 66 by which the belts can be driven from the motor 30. Since the motor drives the axles 40 in opposite directions, the belts 70 are also driven in the opposite direction to enable a well pipe to be pulled when opposite surfaces thereof are engaged by the inwardly facing surfaces of the opposed belts when the belts are in their closed position as illustrated in FIG. 4. The belt drive assemblies 50 are interconnected by flexible latch member 86 which are pivotally connected to one of the plates 82 as at 88 and the other ends of the flexible members 86 have a T-shaped head 90 engaging a pair of spaced bracket structures 92 rigid with the opposite drive assembly with the flexible latch member 86 being resilient in order that it can be stretched and engaged with the brackets 92 with the resiliency of the latch 86 biasing the drive assemblies towards each other and into driving contact with the well pipe.

The arms 52 and 54 include an extending rubber stop 94 which limits its downward pivotal movement toward the base plate 12 to maintain an angular relation of the arms 52 and 54 with respect to the base plate 12 when the arms are inwardly pivoted to the position in which the belt drive assemblies are in their closed condition as illustrated in FIG. 4 with the rubber stopper 94 being mounted on the end of an arm 96 that is rigid with the respective fork arms 52 and 54. The angular position of the fork arms is preferably about 40° to provide the maximum frictional contact between the belt and the pipe being pulled. A power supply is provided through an extension cord of adequate capacity and at the rear end of the plate, an electrical control box 98 is mounted which includes a disconnect plug 100 into which an electrical cord is connected with the electrical cord having a push-button type of control switch associated therewith to control operation of the motor with the push-button arrangement including an up button which, when activated, will pull the pipe, pump, wire and all fittings upwardly from the well at a rate of 50' per minute. The push-button switch also includes a down position making it as easy to extract the pipe as inserting it into the well with all of the electrical components being watertight for proper operation and all of the drive chains are covered with a chain guard for safety.

Figure 7A:
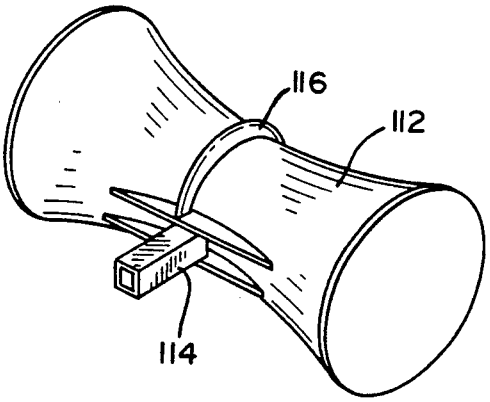
FIGS. 7A–7C are perspective side and end views of the dual cone-shaped pipe guide.
Figure 7C:
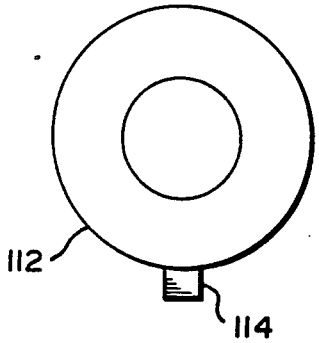
Figure 7B:
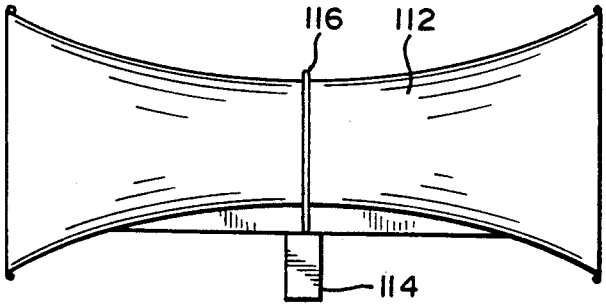
Figure 6A:
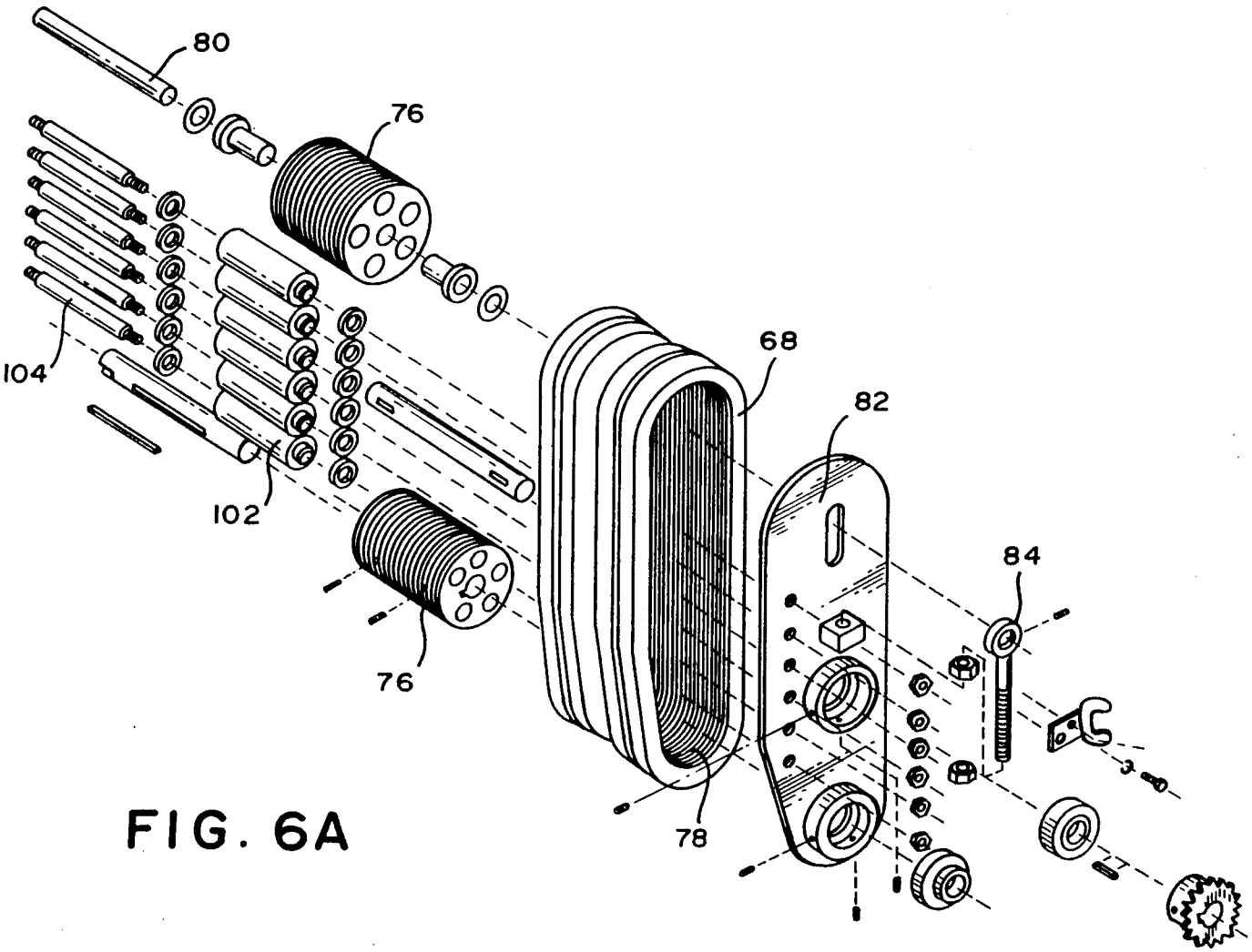
FIGS. 6A–6C are exploded perspective view of component assemblies of the puller.
Figure 6B:
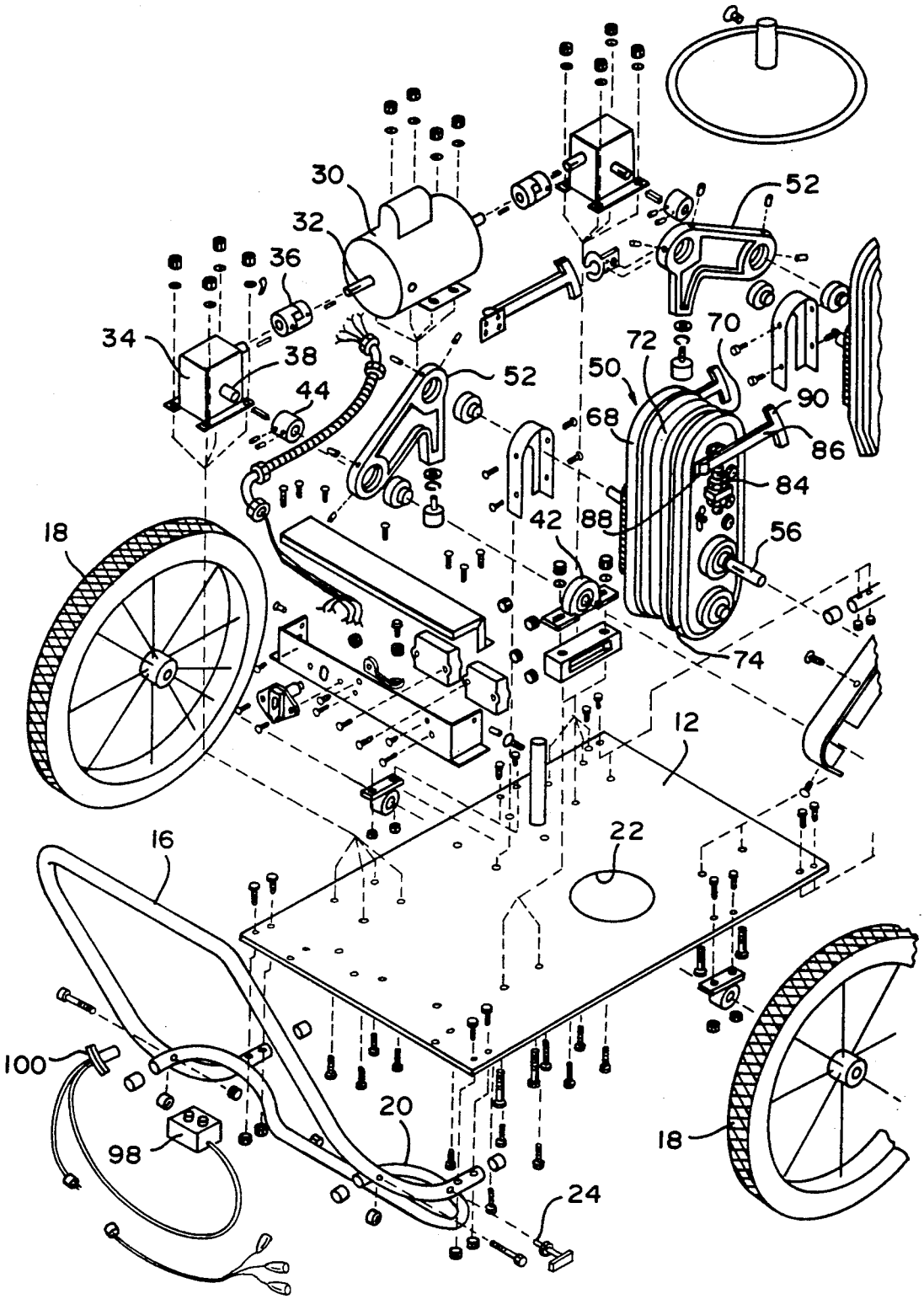
Figure 6C:
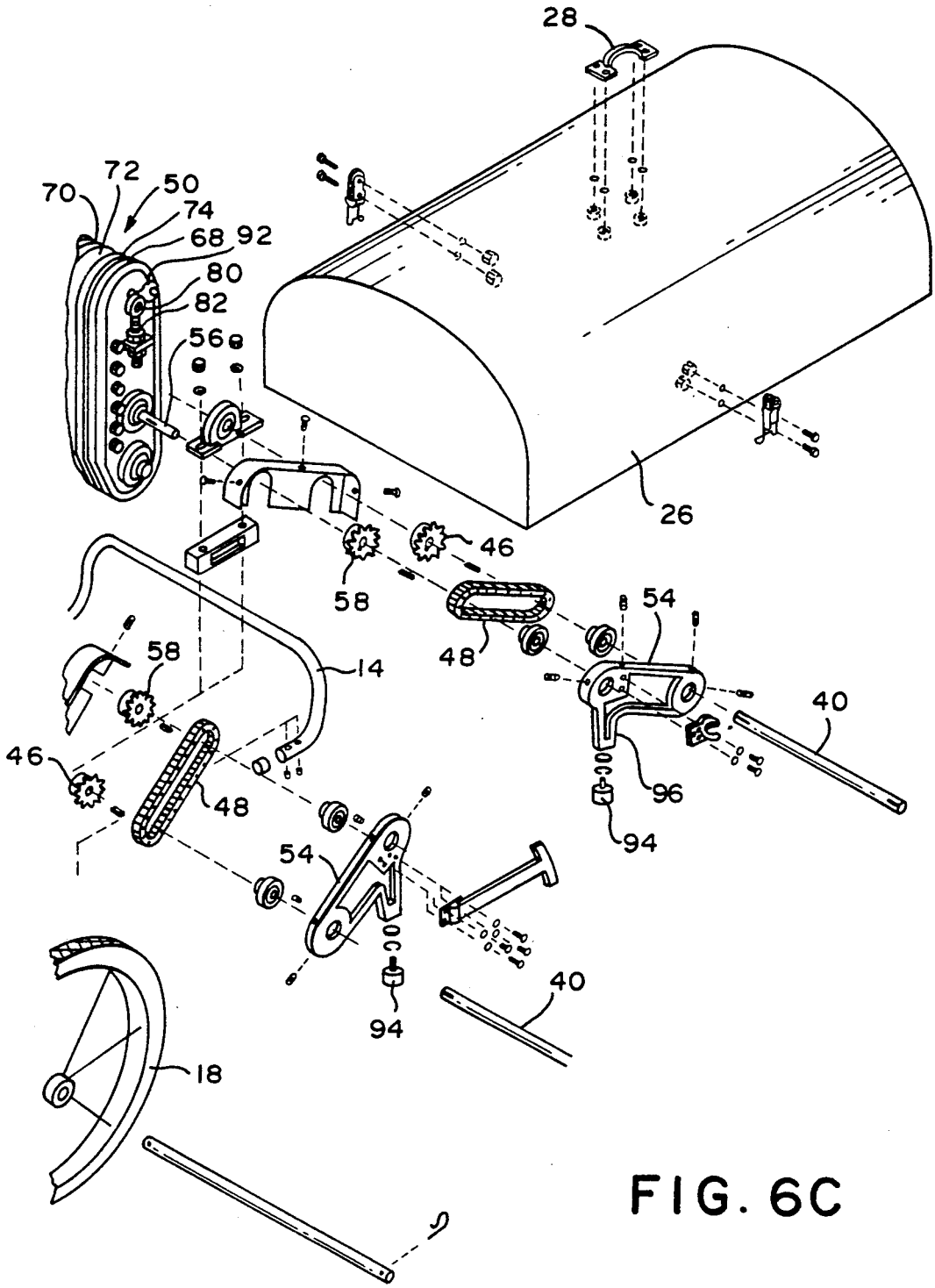

The portion of the belt 70 which engages the pipe is provided with a plurality of rollers 102 which are journaled on axles 104 interconnecting the plates 82 with these rollers providing a backing for the portion of the belt engaged with the pipe to assure proper frictional contact between the pipe and belt. The rubber composition covered puller belt 70 delivers maximum traction and the taper from the outside edge toward the center helps to force the pipe being extracted into the center groove. The two smaller grooves on the puller belt help guide the wire or safety rope and when a sheared off pipe problem is encountered, by guiding the wire into the smaller groove and over the top of the belt, the machine will continue to pull out the system until the pipe is then reengaged by the puller belt. The puller belt tension is adjusted in a conventional manner and the idler rollers are full length and provided with teflon bearings and are covered with a rubber composition to provide a flat rolling soft surface eliminating the need for lubrication. Teflon washers can be used to prevent shifting of the idler rollers on their shafts. FIGS. 7A–7C illustrate a pipe guide 110 for supporting a pipe being pulled from the well and includes a dual cone-shaped member 112 having a depending centrally disposed support member 114 in the form of a tubular sleeve reinforced by gussets 116 where it connects with member 112. A peripheral flange 116 is provided at the center or smaller diameter area of the member 112. The guide 110 is supported in elevated position above the puller 10 and supports a rigid sectional pipe as it is pulled from the well to enable the pipe to assume an arcuate configuration. This permits the pipe to be pulled from the well in a continuous operation without stopping the pulling operation to separate the pipe into individual sections. The guide 110 is supported by a pipe (not shown) which may have a length of about 10 feet to position the guide in a position to guide a pipe being pulled from the well. After the pipe has been removed from the well or inserted into the well, the machine can be unplugged and disconnected by releasing the latches 86 and unscrewing a pull bar from the pitless adapter and lifting the machine off the well casing by utilizing the handles and wheeling the unit off the site. When removing the pipe, the normal procedure is followed by placing a pull bar into the well and threading it into a pitless adapter which disconnects when lifted up which is accomplished when the belt drive assemblies are in their open position and after the belt drive assemblies are moved into the closed or working position, they engage the pull bar with the center groove of the puller belts 70. With the flexible resilient draw latches secured in place, the mechanical set up is complete and the disconnect plug 34 is connected with the extension cord which is plugged into a 110 volt outlet. The up button in the switch in the electrical cord can be depressed which will cause the pipe, pump, wire and all fittings to be moved out of the well.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An apparatus for moving a well pipe, pump and other downhole equipment in relation to a well bore, said apparatus comprising a frame, wheel means supporting said frame, handle means on said frame to enable the apparatus to be moved into overlying relation to a well bore, a pair of opposed well pipe engaging means on aid frame, each of said well pipe engaging means including a belt assembly, means on said frame drivingly connected to the belt assemblies for driving them in opposite directions, each belt assembly including an elongated endless belt including a vertically elongated portion, said vertically elongated portions being disposed in opposed facing relation for engaging opposed vertical external surfaces of a pipe for moving the pipe longitudinally when the belts are driven, said belt being flexible and constructed of resilient material and provided with an outer surface having a longitudinal central groove means for engaging pipes and other well bore equipment having various external surface characteristics, each of said belts being mounted on a pair of spaced multi-grooved pulleys, shaft means supporting said pulleys from a pair of side plates with one of said pulley shafts being adjustable to tension the belt and gear drive means connected to one of the shaft means supporting each pair of pulleys for driving the pulleys.

2. The apparatus of claim 1 wherein said means driving said belts including a single motor having a pair of oppositely extending output shafts drivingly connected to a pair of spaced, horizontal axles, and means fixedly associating the frame with the well bore including a vertically disposed tubular member mounted on the frame and forming a vertical passage through the frame with the axles being spaced to either side of the tubular member.

3. The apparatus as defined in claim 2 wherein each axle is provided with a pair of spaced parallel support arms pivotally mounted on the axle, said arms pivotally supporting the axle means supporting one of said pulleys to enable the belts to swing between a closed position in engagement with a pipe and open position in spaced relation thereto.

4. The apparatus as defined in claim 3 wherein said support arms include a bumper structure engaging the frame to limit the angular movement of the arms toward a closed position of said belts.

5. The apparatus as defined in claim 1 wherein each of said belts is supported by a plurality of idler rollers journaled between the side plates along a portion of the inner surface of the belt engaged with a pipe to provide a backing support for the portion of the belt engaging the pipe.

6. The apparatus as defined in claim 2 wherein said motor is an electric motor and said frame includes separable plug means for connection with an electrical supply cord having control means associated therewith.

7. The apparatus as defined in claim 6 wherein said motor has its oppositely extending shafts oriented longitudinally of the frame and drivingly connected to said axles which are oriented transversely of the frame through speed reducers and couplings.

8. The apparatus as defined in claim 1 wherein said wheel means includes relatively large diameter spoked wheels, means detachably connecting the wheels to the frame to enable the frame to be mounted flush in relation to a well.

9. An apparatus for moving a well pipe, pump and other downhole equipment in relation to a well bore, said apparatus comprising a frame, wheel means supporting said frame, handle means on said frame to enable the apparatus to be moved to a well site, said frame including means fixedly relating the frame to a well bore, a pair of well pipe engaging means on said frame with each of said well pipe engaging means including a belt assembly, means on said frame drivingly connected to the belt assemblies for driving them in opposite directions, each belt assembly including an elongated endless belt having a width greater than the width of a pipe to be engaged and including a vertically elongated portion facing and engaging a pipe to be pulled, said belt being flexible and constructed of resilient material and provided with an outer surface having a central groove and outwardly tapering surfaces from the central groove toward the side edges thereof for engaging a pipe for moving the pipe longitudinally when the belts are driven, said means driving said belts including a single motor having a pair of oppositely extending output shafts drivingly connected to a pair of spaced, horizontal axles, said means fixedly associating the frame with the well bore including a vertically disposed tubular member mounted on the frame and forming a vertical passage through the frame with the axles being spaced to either side of the tubular member, each axle being provided with a pair of spaced parallel support arms pivotally mounted on the axle, said arms pivotally supporting the axle means supporting one of said pulleys to enable the belts to swing between a closed position in engagement with a pipe and open position in spaced relation thereto, said support arms including a bumper structure engaging the frame to limit the angular movement of the arms toward a closed position of said belts, each of said belts being supported by a plurality of idler rollers journaled between the side plates along a portion of the inner surface of the belt engaged with a pipe to provide a backing support for the portion of the belt engaging the pipe, said motor being an electric motor and said frame including separable plug means for connection with an electrical supply cord having control means associated therewith, said motor having its oppositely extending shafts oriented longitudinally of the frame and drivingly connected to said axles which are oriented transversely of the frame through speed reducers and couplings, said wheel means including relatively large diameter spoked wheels, means detachable connecting the wheels to the frame to enable the frame to be mounted flush in relation to a well, said handle means including a front U-shaped handle and a rear U-shaped handle to enable the apparatus to be pushed or pulled and easily lifted, one end of said frame including retractable support leg means to support the frame generally in a horizontally position when the wheels are mounted on the frame.

10. The apparatus as defined in claim 9 wherein said retractable leg support means includes a U-shaped leg pivotally attached to said rear handle means to support the frame when the wheels are in place on the frame, and means releasably securing said U-shaped leg to enable the U-shaped leg to pivot to an upwardly extending position to enable the frame to be pivoted on the wheels.

11. The apparatus as defined in claim 9 including a guide supported in elevated relation to said frame for guiding a pipe during longitudinal movement, said guide including a tubular member through which the pipe extends when being moved longitudinally in relation to a well bore.

12. The apparatus as defined in claim 1 wherein the longitudinal central groove means in each belt is defined by a central longitudinal groove in the outer surface of the belt with the surface areas of the belt outwardly of the groove being inclined outwardly to generally conform with the contour of the pipe thereby enabling effectively gripping engagement with the pipe during longitudinal movement and effectively gripping the pipe against downward vertical movement when the belts are not being driven, said means drivingly connected to the belt assemblies including a worm gear drive to prevent movement of the belts when the belts are not being driven with the gripping engagement between the belts and the pipe preventing downward movement of the pipes in relation to a well bore due to the force of gravity when the belts are not being driven.

13. The apparatus as defined in claim 3 including resilient means interconnecting said arms in spaced relation to the axles to retain the belt assemblies in engaged relation with a pipe, said means being separable from one of said arms to enable the support arms to pivot toward an open position.

14. The apparatus as defined in claim 3 wherein the pivotal support of the arms enables the arms and the belt assemblies mounted to move toward and away from each other to enable the belt assemblies to effectively grip different size pipes or other equipment normally removed from or placed in a well bore.

* * * * *